US006186171B1

(12) United States Patent
Tanaka et al.

(10) Patent No.: US 6,186,171 B1
(45) Date of Patent: Feb. 13, 2001

(54) PNEUMATICALLY DRIVEN LIQUID SUPPLY APPARATUS

(75) Inventors: Hiroshi Tanaka, Kurume; Yasuhiro Chouno, Tosu; Takashi Terada, Kumamoto; Satoshi Nakashima, Tamana-gun, all of (JP)

(73) Assignee: Tokyo Electron Limited, Tokyo (JP)

( * ) Notice: Under 35 U.S.C. 154(b), the term of this patent shall be extended for 0 days.

(21) Appl. No.: 09/268,183

(22) Filed: Mar. 15, 1999

(30) Foreign Application Priority Data

Mar. 17, 1998 (JP) ..... 10-088048

(51) Int. Cl.[7] ..... F04B 49/00
(52) U.S. Cl. ..... 137/565.34; 417/9
(58) Field of Search ..... 137/565.34; 417/9

(56) References Cited

U.S. PATENT DOCUMENTS 5,501,577 * 3/1996 Cornell et al. ..... 417/9

* cited by examiner

*Primary Examiner*—Gerald A. Michalsky
(74) *Attorney, Agent, or Firm*—Morrison & Foerster

(57) ABSTRACT

In a pneumatically driven liquid supply apparatus comprising a circulation pump 26 or constant-volume pump 34 for supplying a washing liquid or chemical to a washing tank 20 for semiconductor wafers used during the fabrication of semiconductor devices; an electromagnetic switching valve 51 and a pressure regulator 52 that configure an air-pressure adjustment means 50 are connected to an air source 60; and air supply pipelines 41*a*, 41*b*, 41*d*, and 41*e* are each connected to the air-pressure adjustment means 50, the circulation pump 26 and the constant-volume pump 34. A leakage sensor 70 is interposed within each of the air supply pipelines 41*a*, 41*b*, 41*d*, and 41*e* between the air-pressure adjustment means 50 and the circulation pump 26 or constant-volume pump 34, so that any liquid that flows backward through the circulation pump 26 or the constant-volume pump 34 and into the air supply pipeline 41*a*, 41*b*, 41*d*, or 41*e* is detected by the leakage sensor 70. This makes it possible to prevent damage or halting of the functions of the air-pressure adjustment means due to liquid flowing into the air supply pipelines via one of the pumps.

13 Claims, 5 Drawing Sheets

PNEUMATICALLY DRIVEN LIQUID SUPPLY APPARATUS

BACKGROUND OF THE INVENTION

1. Technical Field of the Invention

The present invention relates to a pneumatically driven liquid supply apparatus adapted in particular for use in a washing step in semiconductor manufacturing process.

2. Description of Prior Art

A washing method widely used during the process of manufacturing semiconductors or the like generally involves immersing objects to be processed, such as semiconductor wafers or glass substrates for LCDs (hereinafter called "wafers"), into a series of washing tanks, each filled with a washing liquid such as a chemical or a rinse liquid (pure water).

A liquid supply apparatus known in the art as a washing apparatus for performing the above washing process is provided with a washing tank filled with a washing liquid such as a chemical or a rinse liquid (pure water), into which the wafer or the like is immersed; a circulatory liquid supply apparatus that allows washing liquid to overflow from the washing tank and also allows it to recirculate and be supplied; and a liquid supply apparatus for replenishment that replenishes the washing liquid, such as a chemical, into the washing tank.

This liquid supply apparatus is also provided with a liquid supply means such as a reciprocating circulatory pump for supplying the washing liquid to the washing tank and a pulsation damping means such as a damper for controlling any pulsations in the liquid on the discharge side of the circulatory pump, in such a manner that the pump and the damper are connected to an air source via an air-pressure adjustment means, such as a regulator, and an electromagnetic switching valve, and that a predetermined air pressure is thereby supplied to the pump and damper, and a predetermined quantity of the washing liquid is circulated and supplied to the washing tank. In addition, a reciprocating type of pump such as a bellows pump is used as a liquid supply means for replenishment, such as a chemical replenishment pump, for supplying into the washing tank a predetermined quantity of a chemical that is within a chemical replenishment tank, this pump is connected to an air source via a regulator and an electromagnetic switching valve, and thus a predetermined quantity of the chemical is supplied into the washing tank by the supply of a predetermined air pressure thereto.

In the above described pneumatically driven liquid supply apparatus using air pressure, there is a danger that liquid within the liquid pipeline could flow backward into the air supply pipeline because of abrasion due to long-term usage or some other cause. If this backflow of liquid within the air supply pipeline occurs, the liquid will intrude into the components of the air-pressure adjustment means, that is, the electromagnetic switching valve and regulator thereof, and damage this electromagnetic switching valve and regulator, make them unable to function, and disable the supply of liquid.

The present invention was made in the light of the above described problem and has as an object thereof the provision of a pneumatically driven liquid supply apparatus that is configured in such a manner to detect any backward flow of the liquid within the air supply pipeline through the pump and damper, and prevent damage or halting of the functions of the air-pressure adjustment means due to such backflow.

SUMMARY OF THE INVENTION

According to the present invention, there is provided a pneumatically driven liquid supply apparatus comprising: a liquid supply pipeline for supplying a liquid to liquid processing means; liquid supply means provided in the liquid supply pipeline; an air supply pathway for supplying air for driving the liquid supply means to the liquid supply means; and air-pressure adjustment means provided in the air supply pathway; wherein the liquid supply apparatus further comprises: liquid detection means provided in the air supply pathway between the air-pressure adjustment means and the liquid supply means, to detect liquid flowing from the liquid supply pipeline through the liquid supply means into the air supply pathway.

The pneumatically driven liquid supply apparatus may comprise flow prevention means operative in response to a detection signal from the liquid detection means.

The liquid supply means is typically a pump.

The liquid supply pipeline may be a liquid circulation pipeline for supplying a liquid taken out from the liquid processing means to the liquid processing means again.

The pneumatically driven liquid supply apparatus may comprise pulsation damping means provided in the liquid supply pipeline downstream of the liquid supply means to damp pulsation of the liquid being fed by the liquid supply means; a second air supply pathway for supplying to the pulsation damping means air for operating the pulsation damping means; second air-pressure adjustment means provided in the second air supply pathway; and second liquid detection means provided in the second air supply pathway between the second air-pressure adjustment means and the pulsation damping means, to detect liquid flowing from the second liquid supply pipeline through the pulsation damping means into the second air supply passageway.

DESCRIPTION OF THE PREFERRED EMBODIMENTS

A preferred embodiment of the present invention will be described below with reference to the accompanying drawings. In the description, the pneumatically driven liquid supply apparatus of this invention will be described as being applied to a washing/drying system for semiconductor wafers.

Figure 1:
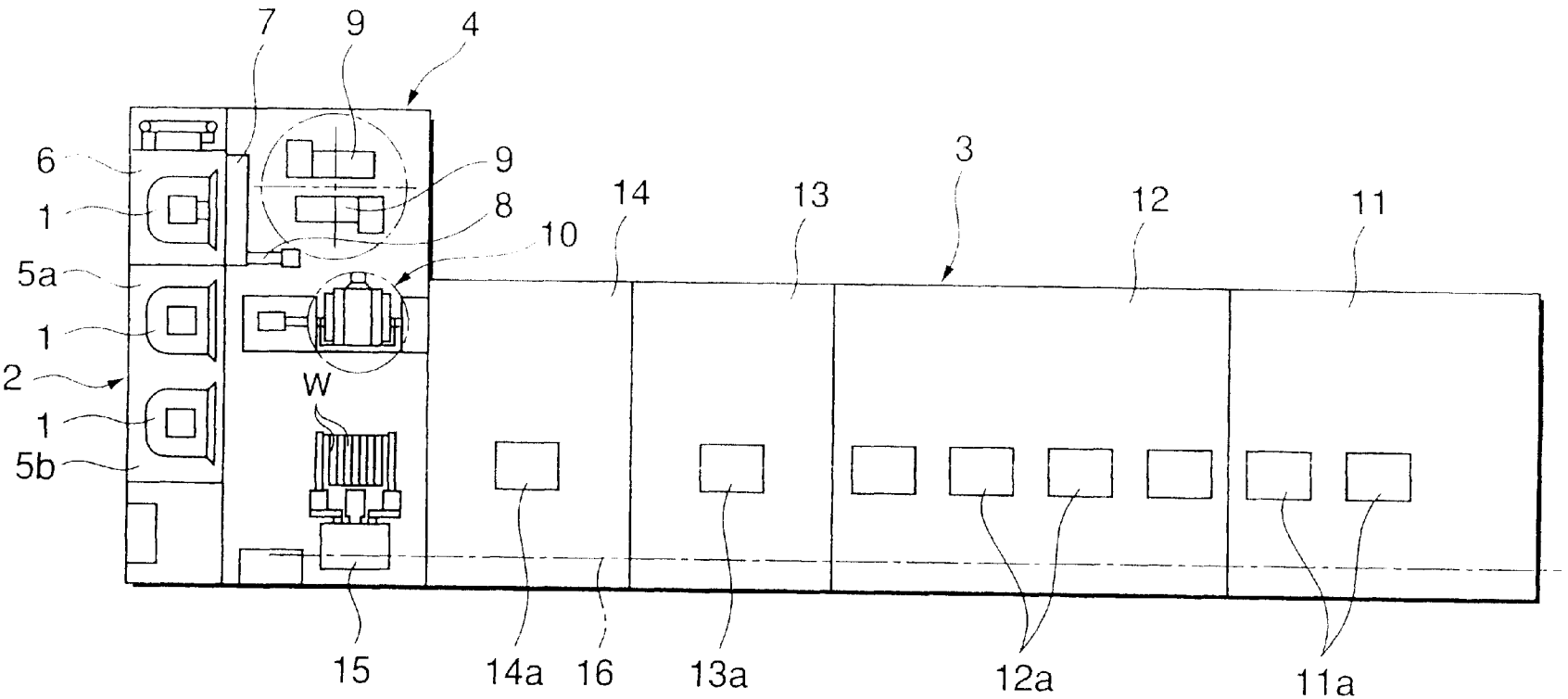
FIG. 1 is a schematic plan view of an example of a washing/drying system for semiconductor wafers, to which the pneumatically driven liquid supply apparatus of this invention is applied.

As shown in FIG. 1, the above mentioned washing/drying system is mainly configured of a conveyor portion 2 for conveying containers such as carriers 1 into and out of the system, where each carrier 1 contains substrates to be processed such as semiconductor wafers W (hereinafter called "wafers") in horizontal attitude; a processing portion 3 for processing the wafers W with chemicals or cleaning fluids and also drying them; and a wafer reception portion such as an interface portion 4 located between the conveyor portion 2 and the processing portion 3, for receiving the wafers W, adjusting the positions thereof, changing the attitudes thereof, and adjusting the spacing thereof.

The conveyor portion 2 is provided with a carrier inlet portion 5*a* and a carrier outlet portion 5*b* together with a wafer transfer portion 6, aligned along one side edge portion of the washing/drying system. In this case, the configuration is such that a conveyor mechanism (not shown in the figure) is arranged between the carrier inlet portion 5*a* and the wafer transfer portion 6, and carriers 1 are conveyed from the carrier inlet portion 5*a* to the wafer transfer portion 6 by this conveyor mechanism.

The processing portion 3 is configured of a first processing section 11, which is provided with a first processing unit 11*a* for removing particles and organic contaminants adhering to the wafers W; a second processing section 12, which is provided with a second processing units 12*a* for removing metal contaminants adhering to the wafers W; a third processing section 13, which is provided with a washing/drying unit 13*a* for removing oxide films adhering to the wafers W and also drying the wafers W; and a fourth processing section 14, which is provided with a chuck washing/drying device 14*a* for washing and drying a wafer conveyor chuck 15. The pneumatically driven liquid supply apparatus of this invention is used in each of the first to third processing units 12*a*, 12*a*, and 13*a* of the processing portion 3 of this configuration. Note that it is not absolutely necessary for the fourth processing section 14 to be disposed between the third processing section 13 and the interface portion 4, and thus it could equally well be disposed between the second processing section 12 and the third processing section 13, or at a location adjacent to the first processing section 11.

A carrier lifter (not shown) is disposed in each of the carrier outlet portion 5*b* and the wafer transfer portion 6, with the configuration being such that empty carriers 1 are transferred by these carrier lifters into a reception portion of a carrier standby portion (not shown) provided above the conveyor portion 2, and out of the carrier standby portion. In this case, a carrier transfer robot (not shown) that is capable of horizontal movement (in the X and Y directions) and vertical movement (in the Z direction) is disposed in the carrier standby portion, with the arrangement being such that empty carriers 1 transferred out of the wafer transfer portion 6 are aligned and also transferred out to the carrier outlet portion 5*b* by this carrier transfer robot. It is also possible to place not only empty carriers but also carriers containing wafers W within this carrier standby portion.

Each of the carriers 1 has an aperture portion (not shown) on one side thereof; is configured of a main carrier body having a holder mechanism (not shown) for holding a plurality of wafers W, such as 25 wafers W, at a suitable spacing in a horizontal state on an inner wall, as well as a lid member (not shown) for closing the aperture portion of the main carrier body; and this lid member can be opened and closed by a lid-opening mechanism 7 that will be described later.

The wafer transfer portion 6 opens into the interface portion 4, and the lid-opening mechanism 7 is disposed in the aperture portion thereof. The configuration is such that the lid members (not shown) of the carriers 1 are opened and closed by this lid-opening mechanism 7. It is therefore possible for the lid-opening mechanism 7 to remove the lid member of a carrier 1 containing unprocessed wafers that has been conveyed into the wafer transfer portion 6, then convey the wafers W out of the carrier 1, and, once all of the wafers W have been transferred, it is then possible for the lid member to be closed again by the lid-opening mechanism 7. In a similar manner, it is possible for the lid-opening mechanism 7 to remove the lid member of an empty carrier 1 that has been conveyed into the wafer outlet portion 6 from the carrier standby portion, then convey wafers W into the carrier 1, and, once all of the wafers W have been transferred, it is then possible for the lid member to be closed again by the lid-opening mechanism 7. Note that a mapping sensor 8 for detecting the number of wafers W accommodated within each carrier 1 is disposed in the vicinity of the aperture portion of the wafer transfer portion 6.

Within the interface portion 4 are disposed a wafer transfer arm 9 for holding a plurality of wafers W, such as 25 wafers W in horizontal attitude and also transferring them in that horizontal attitude to and from the carrier 1 in the wafer transfer portion 6; a spacing adjustment means such as a pitch changer (not shown) for holding a plurality of wafers W, such as 50 wafers W at a predetermined spacing, but in a vertical state; a holder means such as an attitude modification device 10 positioned between the wafer transfer arm 9 and the pitch changer, for changing the attitude of a plurality of wafers W, such as 25 wafers W, from a horizontal state to a vertical state, or from a vertical state to a horizontal state; and a position detection means such as a notch aligner (not shown) for detecting notches provided in wafers W that have been adjusted to a vertical state. A conveyor path 16 linked to the processing portion 3 is also provided in the interface portion 4, and a wafer conveyor chuck 15 is disposed in a freely movable manner on this conveyor path 16 in order to hold the wafers W and convey them along the conveyor path 16 between the first to third processing units 11*a* to 13*a*.

The description now turns to the pneumatically driven liquid supply apparatus in accordance with this invention.

Figure 2:
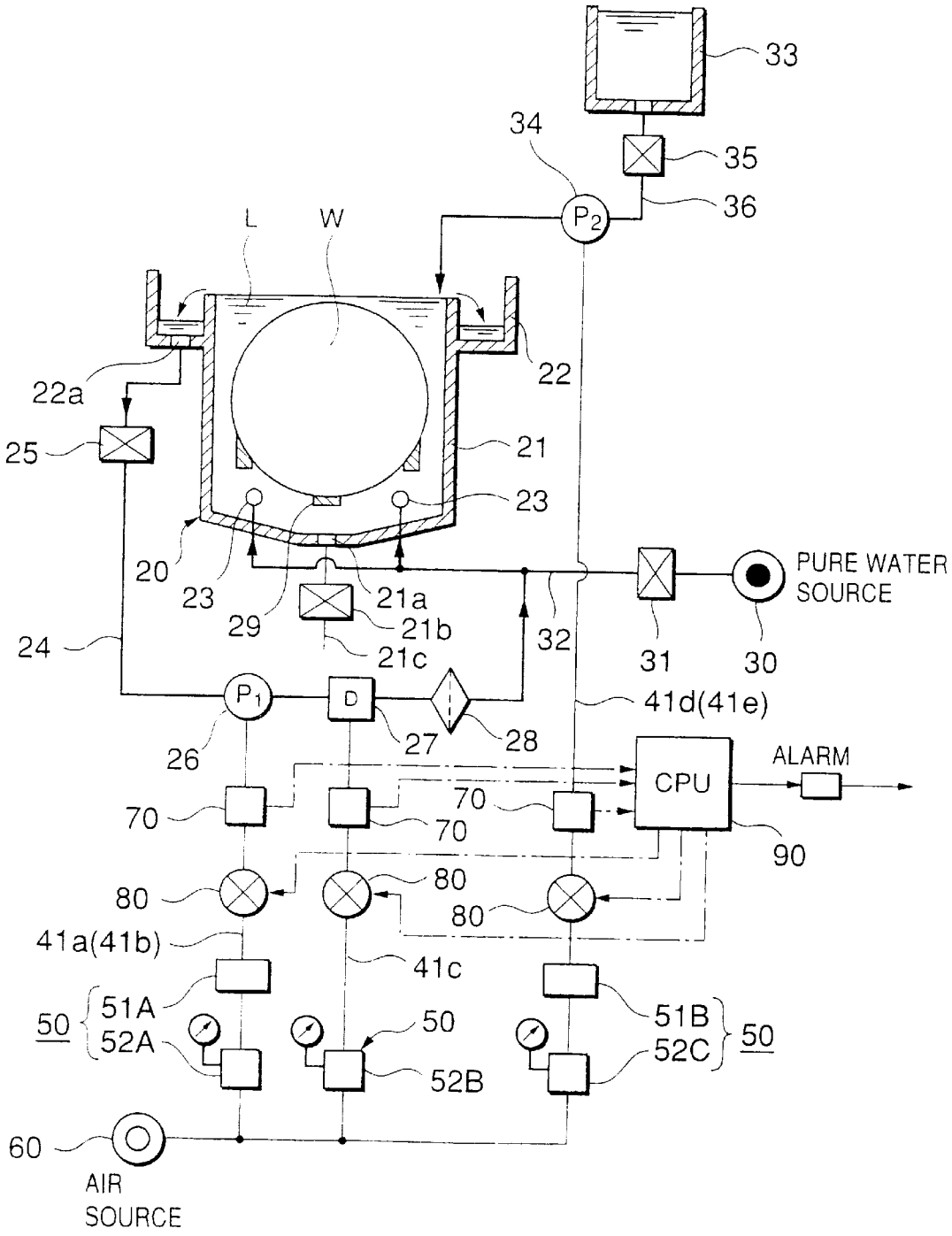
FIG. 2 is a schematic view of an embodiment of the pneumatically driven liquid supply apparatus in accordance with this invention.

An example of a washing apparatus equipped with the liquid supply apparatus of this invention is shown schematically in FIG. 2.

This liquid supply apparatus is provided with a washing vessel 20 that consists of an inner tank 21 in which is accumulated a washing liquid L [such as hydrofluoric acid (HF) in diluted form (DHF) or a rinsing liquid (pure or distilled water)] and an outer tank 22 surrounding an upper opening portion of the inner tank 21, for stopping any overflowing washing liquid L from the inner tank 21; washing liquid supply nozzles 23 that are disposed in a lower portion of the inner tank 21; a circulation pipeline 24 that connects the washing liquid supply nozzles 23 to an exhaust port 22*a* provided in a base portion of the outer tank 22; and a valve 25, a first liquid supply means such as an air-bellows type of circulation pump 26 (hereinafter called the circulation pump), a pulsation damping means such as a damper 27, and a filter 28, provided in the circulation pipeline 24 in sequence from the exhaust port 22*a*. In addition, a supply pipeline 32 for a rinse liquid (pure water) is connected to the circulation pipeline 24 to supply the pure water to the washing liquid supply nozzle 23, and this pure water supply pipeline 32 is connected to a pure water source 30.

The configuration is such that a chemical such as DHF that is accommodated within a replenishment tank 33 is replenished (supplied) into the inner tank 21 of the washing vessel 20 from a chemical supply pipeline 36 through a second liquid supply means such as an air-bellows type of constant-volume pump 34 and a valve 35.

Note that a wafer boat 29 that holds a plurality of wafers W, such as 50 wafers W, is disposed within the inner tank 21 of the washing tank 20. An exhaust port 21*a* provided in a bottom portion of the inner tank 21 is connected to a drain pipeline 21*c* via a drain valve 21*b*.

Figure 3:
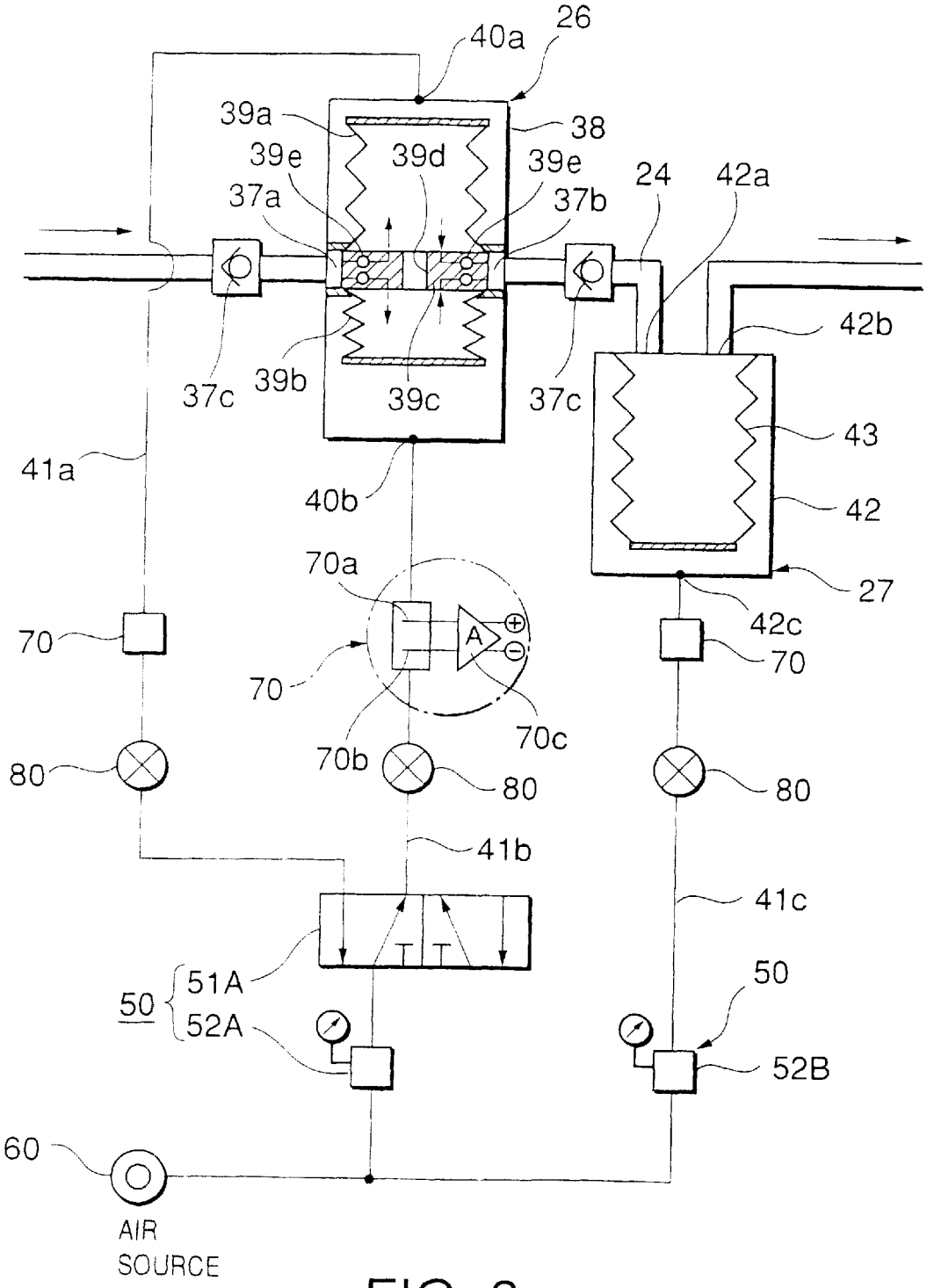
FIG. 3 is a schematic sectional view of pneumatic driving portions of circulation pumps and dampers of the pneumatically driven liquid supply apparatus.

As shown in FIG. 3, the circulation pump 26 is provided with a main pump body 38 made of a material with excellent chemical resistance, such as polytetrafluoroethylene (PTFE), and having a supply port 37*a* and a discharge port 37*b* connected to the circulation pipeline 24; as well as a pair of freely expandable bellows 39*a* and 39*b* made of a material such as PTFE, on either side of the communicating passages 37*a* and 37*b*. First and second air supply pipelines 41*a* and 41*b* are connected to air supply ports 40*a* and 40*b* to supply air to the corresponding bellows 39*a* and 39*b* of the circulation pump 26, and the two air supply pipelines 41*a* and 41*b* are connected to an air source 60 via a three-port/two-position switching electromagnetic valve 51A (hereinafter called an electromagnetic switching valve) and a pressure regulator 52A that together form an air-pressure adjustment means 50. A non-return valve 37*c* is disposed at each side of the supply port 37*a* and discharge port 37*b* of the circulation pump 26.

A partition 39*c* is provided between the bellow 39*a* and 39*b*. The partition 39*c* has an opening 39*d* that allows communication between the interior spaces of the bellows 39*a* and 39*b*. One of these bellows expands while the other contracts to carry out the pumping operation of the circulation pump 26. The opening 39*d* is provided to allow the expansion and contraction of the two bellows. The partition 39*c* is formed therein with liquid passages for connecting the supply part 37*a* with the interiors of the bellows, respectively, and a check valve 39*e* is provided in each of these liquid passages. The partition 39*c* is also formed therein with liquid passages for connecting the interiors of the two bellows with the discharge port 37*b*, respectively, and a check valve 39*e* is provided in each of these liquid passages.

When pressurized air is supplied from the air supply pipeline 41*b* into the pump body 38, the bellows 39*b* contracts so that liquid in the bellows 39*b* is fed to the discharge port 37*b* through the associated liquid passage with the check valve 39*e*. When pressurized air is supplied from the air supply pipeline 41*a* into the pump body 38, the bellows 39*a* contracts so that liquid in the bellows 39*a* is fed to the discharge port 37*b* through the associated liquid passage with the checkvalve 39*e*. Thus, a pumping operation is performed.

In addition, within each of the air supply pipelines 41*a* and 41*b* is disposed a liquid detection means such as a leakage sensor 70, for detecting any flow of liquid within the corresponding air supply pipeline 41*a* or 41*b*, and a flow prevention means such as a check valve 80, for exhausting any flowing liquid to a location such as the outside, in sequence from the side of the circulation pump 26 to the secondary side of the air-pressure adjustment means 50, in other words, on the side of the circulation pump 26 of the electromagnetic switching valve 51A. As shown on an enlarged scale in FIG. 3, the leakage sensor 70 is configured of a positive (+) electrode terminal 70*a* that is inserted in the interior of the air supply pipeline 41*b*, by way of example, an opposite negative (−) electrode terminal 70*b*, and an amplifier 70*c* that amplifies a voltage that occurs when a liquid flowing within the air supply pipeline 41*b* electrically connects the electrode terminals 70*a* and 70*b*. Note that the check valve 80 is not limited to a configuration that exhausts liquid to the outside, and it could be configured such that the supplied air is allowed to flow but a non-return valve prevents liquid from flowing into the side of the air-pressure adjustment means 50, by way of example.

The configuration is such that a detection signal detected by the leakage sensor 70 is transferred to a control means such as a central processing unit (CPU) 90 (FIG. 2), then a signal that has been processed by the CPU 90 is transferred to the check valve 80. This configuration ensures that, if liquid is detected by the leakage sensor 70 to be flowing through the circulation pump 26 and into the air supply pipelines 41*a* and 41*b*, a detection signal is sent to the CPU 90, an output signal is sent from the CPU 90 to the check valve 80, the check valve 80 operates, and thus the liquid flowing within the air supply pipelines 41*a* and 41*b* can be exhausted to the outside. This means that liquid can be prevented from intruding into the electromagnetic switching valve 51A and regulator 52A, to thus prevent damage or malfunction of the electromagnetic switching valve 51A and regulator 52A. An alarm could be raised by the output signal from the CPU 90, to inform the operator or other personnel that liquid is flowing into the air supply pipelines 41*a* and 41*b*.

As shown in FIG. 3, the damper 27 is provided with a main damper body 42 made of a material with excellent chemical resistance, such as PTFE, and has an inlet port 42*a* and a discharge port 42*b* connected to the circulation pipeline 24; a bellows 42*d* made of a material such as PTFE and capable of expanding within the main damper body 42 between the inlet port 42*a* and discharge port 42*b*; and an air supply port 42*c* for supplying air to the bellows 42*d*. A third air supply pipeline 41*c* is connected to the air supply port 42*c* and this third air supply pipeline 41*c* is connected to the air source 60 through a pressure regulator 52B that configures the air-pressure adjustment means 50. Pressurized air is supplied into the bellows 42*d* of the damper 27 through the air supply port 42*c*. The timing of the supply of the air is so determined as to cancel the pulsation of the liquid fed into the circulation pipeline 24 by means of the circulation pump 26, so that a flow of the liquid with a reduced pulsation from the damper 27 is produced.

Within the third air supply pipeline 41*c* is disposed a liquid detection means such as another leakage sensor 70, for detecting any flow of liquid within the air supply pipeline 41*c*, and a flow prevention means such as a check valve 80, for exhausting any flowing liquid to a location such as the outside, in sequence from the side of the damper 27 to the secondary side of the air-pressure adjustment means 50, in other words, on the side of the damper 27 of the regulator 52B. Note that, in this case too, the CPU 90 is also connected to this leakage sensor 70 so that, if liquid is detected by the leakage sensor 70 to be flowing through the third air supply pipeline 41*c*, a detection signal is sent to the CPU 90, an output signal is sent from the CPU 90 to the check valve 80, and also an alarm is raised.

Figure 4:
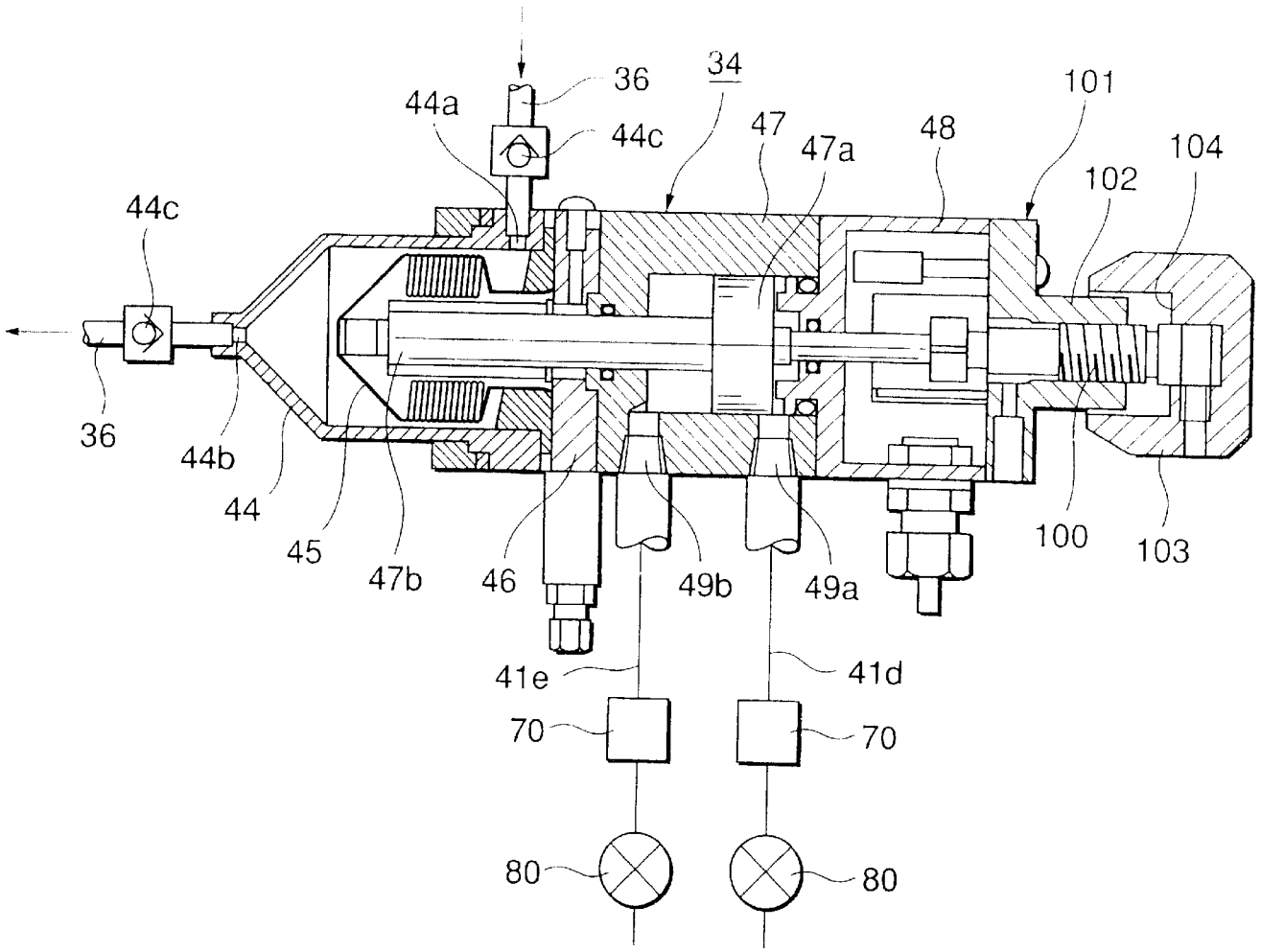
FIG. 4 is a schematic sectional view of a constant-volume pump used in the pneumatically driven liquid supply apparatus.

As shown in FIG. 4, the constant-volume pump 34 for adding replenishment chemicals is provided with a pump head (pump casing) 44 made of a material with excellent chemical resistance, such as PTFE and having a supply port 44*a* and a discharge port 44*b* connected to the chemical supply pipeline 36; a pumping member such as a bellows 45 made of a material such as PTFE and disposed in a freely expandable manner within the pump head 44; a cylinder 47 made of a material such as polyvinyl chloride (PVC) and connected to the pump head 44 by a connection member 46, also made of a material such as PVC; a cover 48 made of a material such as PVC, for closing an open end portion of the cylinder 47; and a piston head 47*b* linked to a piston 47*a* that slides within the cylinder 47 to project into the pump head 44 and cause the bellows 45 to expand or contract. A non-return valve 44*c* is disposed on the side of each of the supply port 44*a* and the discharge port 44*b*. This makes it possible to achieve a sufficient chemical resistance, even with respect to acids such as DHF and alkaline chemicals, by forming the pump portions of the constant-volume pump 34, in other words, the pump head 44 and the bellows 45, of a composite resin with excellent chemical resistance, such as PTFE.

Air supply ports 49*a* and 49*b* are provided at each end portion of the cylinder 47, fourth and fifth air supply pipelines 41*d* and 41*e* are connected to these air supply ports 49*a* and 49*b*, respectively, and each of the air supply pipelines 41*d* and 41*e* is connected to the air source 60 through an electromagnetic switching valve 51B (FIG. 2) and a pressure regulator 52C (FIG. 2) of an air-pressure adjustment means 50. Therefore, air supplied from the air source 60 can be adjusted to a predetermined pressure by the regulator 52C and also switched by the electromagnetic switching valve 51B so as to be supplied into either one of the cylinder chambers on both sides of the piston 47*a* in the cylinder 47. As a result, the piston 47*a* is moved in reciprocation to expand or contract the bellows 45 by the piston head 47*b*, so that a predetermined quantity of a chemical can be supplied (replenished) into the washing tank 20.

In addition, within each of the air supply pipelines 41*d* and 41*e* is disposed a liquid detection means such as a leakage sensor 70, for detecting any flow of liquid within the corresponding air supply pipeline 41*d* or 41*e*, and a flow prevention means such as a check valve 80, for exhausting any flowing liquid to a location such as the outside, in the above order from the side of the constant-volume pump 34 to the secondary side of the air-pressure adjustment means 50, in other words, on the side of the constant-volume pump 34 of the electromagnetic switching valve 51B. The CPU 90 is also connected to these leakage sensors 70 so that, if liquid is detected by one of these leakage sensor 70 to be flowing back through the corresponding air supply pipeline 41*d* or 41*e*, a detection signal is sent to the CPU 90, an output signal is sent from the CPU 90 to the check valve 80, and also an alarm is raised.

Figure 5:
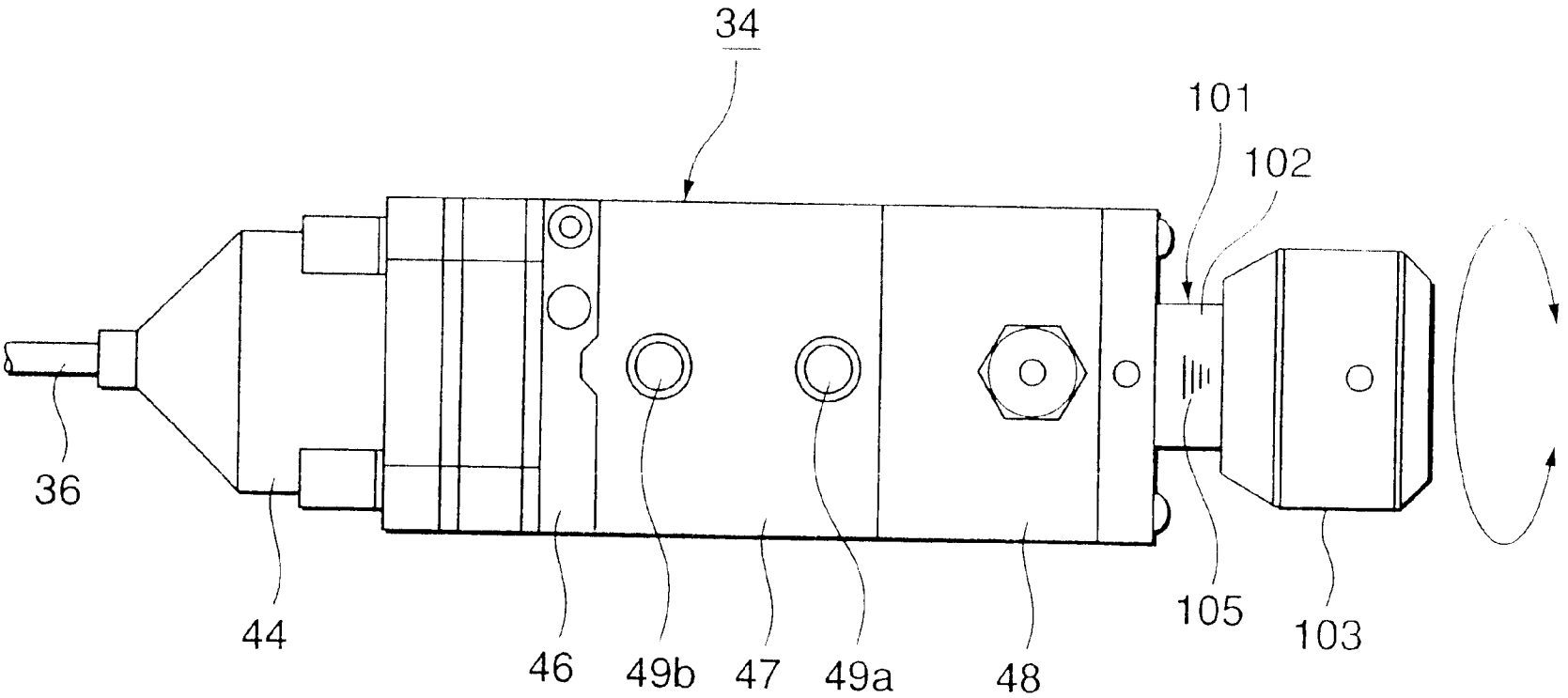
FIG. 5 is a bottom view of FIG. 4.

The constant-volume pump 34 for chemical replenishment must be made of a material with excellent chemical resistance and must also be able to discharge (supply) the target flow rate accurately into the washing tank 20. For that reason, an adjustment screw 100 for adjusting the flow rate of the chemical is linked through the piston 47*a* to the piston head 47*b* in the apparatus of this invention. This adjustment screw 100 passes through the cover 48 and also threadedly engages with and protrudes outwards through a cylindrical portion 102 of an end member 101 which is linked to an end portion of the cover 48. A dial 103 is mounted on a protruding portion of the adjustment screw 100. In this case, the configuration is such that the dial 103 is provided with a concave portion 104 that covers the end portion of the cylindrical portion 102 of the end member 101, and the amount of expansion or contraction of the bellows 45, in other words, the flow rate of the chemical, can be adjusted to an accuracy of, for example, 10+/−1 milliliters/shot by adjusting the distance between the bottom of the concave portion 104 of the dial 103 and the end of the cylindrical portion 102 of the adjustment casing 101. The adjusting operation can be facilitated by aligning an edge portion of the dial 103 against gradations 105 incised into the surface of the cylindrical portion 102 of the adjustment casing 101 as shown in FIG. 5.

Wafers W are immersed in the washing liquid L that is supplied through the supply nozzles 23 and accumulated within the inner tank 21 of the washing tank 20, to be washed thereby. When the washing liquid L is supplied by means of the pneumatically driven liquid supply apparatus configured as described above, air supplied from the air source 60 is adjusted to a predetermined pressure by the regulator 52A and the circulation pump 26 is driven by the operation of switching the electromagnetic switching valve 51A, so that the washing liquid L can be recirculated to overflow from the inner tank 21 to the outer tank 22. In addition, pulsations in the recirculated washing liquid can be suppressed by supplying the damper 27 with air that has been adjusted to a predetermined pressure by the regulator 52B, making it possible to maintain a constant flow-rate of the washing liquid. If the amount of the washing liquid L within the washing tank 20 decreases and it becomes necessary to replenish it, air supplied from the air source 60 is adjusted to a predetermined pressure by the regulator 52C and the constant-volume pump 34 is driven by the operation of switching the electromagnetic switching valve 51B, so that a predetermined quantity of chemical is supplied (replenished) into the washing tank 20.

If, by some chance, liquid (either washing liquid or a chemical) should flow backward within the circulation pipeline 24 or one of the air supply pipelines 41*a*, 41*b*, 41*c*, 41*d* and 41*e* through either the circulation pump 26 and damper 27 or the constant-volume pump 34 during the washing of the wafers W as described above, it can be detected by the corresponding leakage sensor 70, a detection signal therefrom is sent to the CPU 90, an output signal from the CPU 90 is sent to the corresponding check valve 80, and also an alarm is raised. Damage and malfunctioning of components of the air-pressure adjustment means 50 such as the electromagnetic switching valves 51A and 51B and the regulators 52A to 52C can therefore be prevented by halting any flow of liquid within the air supply pipelines 41*a* to 41*e* by the check valves 80 or by exhausting it to the exterior. In addition, the raising of the alarm makes it possible to inform the operator that liquid is flowing backward within the air supply pipelines 41*a* to 41*e* so that the operator can take appropriate action, such as halting the apparatus, to prevent damage or the like that would be caused by the flowing liquid to components of the air-pressure adjustment means 50 such as the electromagnetic switching valves 51A and 51B and the regulators 52A to 52C.

Note that, although the above embodiment relates to a case in which the pneumatically driven liquid supply apparatus of this invention is being applied to a washing/drying system for semiconductor wafers, it should be obvious that it can also be applied to a washing/drying system for substrates other that semiconductor wafers, such as glass substrates for LCDs. In addition, the pneumatically driven liquid supply apparatus of this invention is not limited to a case in which it is used as part of a washing/drying system for semiconductor wafers, and thus it can also be used as an independent device.

The present invention enables the use of a liquid detection means to detect any liquid flowing within the air supply pipeline via the liquid supply means, and also indicate the location of the leakage of liquid by a detection signal, thus making it possible to prevent damage or malfunctioning of the air-pressure adjustment means, improving the reliability of the apparatus.

The present invention uses a liquid detection means to detect any liquid flowing into the air supply pipeline via the liquid supply means and also operates flow prevention means interposed in the air supply pipelines on the secondary side of the air-pressure adjustment means, making it possible to prevent the intrusion of liquid into the air-pressure adjustment means, thus making it possible to prevent damage or malfunctioning of the air-pressure adjustment means due to the flowing liquid to a greater degree, further improving the reliability of the apparatus.

The present invention enables the use of a liquid detection means to detect any liquid flowing into the air supply pipeline via the liquid supply means or the pulsation mediation means, and also indicate the location of the leakage of liquid by a detection signal, thus making it possible to prevent damage or malfunctioning of the air-pressure adjustment means, improving the reliability of the apparatus.

What is claimed is:

1. A pneumatically driven liquid supply apparatus comprising:

a liquid supply pipeline for supplying a liquid to liquid processing means;

liquid supply means provided in the liquid supply pipeline, said liquid supply means being a reciprocating pump having first and second air ports;

a pressurized air source;

a first air supply pipeline for connecting said air source to said first air port;

a second air supply pipeline for connecting said air source to said second air port;

a switching valve provided in said first and second air supply pipelines to selectively connect said air source to said first and second air ports to drive the pump in a first and a second direction, respectively;

air-pressure adjustment means provided for adjusting air pressure in said first and second air supply pipelines;

wherein said liquid supply apparatus further comprises:

a first liquid detection sensor provided in said first air supply pipeline between said switching valve and said first air port, to detect liquid flowing from the liquid supply pipeline through the first air port into said first air supply pipeline; and a second liquid detection sensor provided in said second air supply pipeline between said switching valve and said second air port, to detect liquid flowing from the liquid supply pipeline through the second air port into the second air supply pipeline.

2. The pneumatically driven liquid supply apparatus according to claim 1, further comprising:

flow prevention means operative in response to a detection signal from the liquid detection sensor.

3. The pneumatically driven liquid supply apparatus according to claim 2, wherein said flow prevention means is a check valve.

4. The pneumatically driven liquid supply apparatus according to claim 1, wherein said liquid supply means is a pump.

5. The pneumatically driven liquid supply apparatus according to claim 4, wherein said pump is a constant-volume pump and comprises:

a pump casing having a supply port and a discharge port;

a pumping member provided in the pump casing for expansion and contraction to feed the liquid from the supply port to the discharge port; and an adjustment member for adjusting an extent of the expansion and contraction of the pumping member.

6. The pneumatically driven liquid supply apparatus according to claim 1, wherein said liquid supply pipeline is a liquid circulation pipeline for supplying a liquid taken out from the liquid processing means to the liquid processing means again.

7. A pneumatically driven liquid supply apparatus comprising:

a liquid supply pipeline for supplying a liquid to liquid processing means;

liquid supply means provided in the liquid supply pipeline;

an air supply pathway for supplying air for driving the liquid supply means to the liquid supply means; and air-pressure adjustment means provided in the air supply pathway;

wherein said liquid supply apparatus further comprises:

liquid detection means provided in the air supply pathway between the air-pressure adjustment means and the liquid supply means, to detect liquid flowing from the liquid supply pipeline through the liquid supply means into the air supply pathway, wherein said liquid detection means comprises:

a positive electrode terminal;

a negative electrode terminal; and an amplifier for amplifying a voltage that is produced when said electrode terminals are electrically connected by the liquid.

8. A pneumatically driven liquid supply apparatus comprising:

a liquid supply pipeline for supplying a liquid to liquid processing means;

liquid supply means provided in the liquid supply pipeline;

a first air supply pathway for supplying air for driving the liquid supply means to the liquid means;

air-pressure adjustment means provided in the first air supply pathway;

a first liquid detection sensor provided in the air supply pathway between the air-pressure adjustment means and the liquid supply means, to detect liquid flowing from the liquid supply pipeline through the liquid supply means into the air supply pathway;

pulsation damping means provided in the liquid supply pipeline downstream of the liquid supply means to damp pulsation of the liquid being fed by the liquid supply means;

a second air supply pathway for supplying to the pulsation damping means air for operating the pulsation damping means;

second air-pressure adjustment means provided in the second air supply pathway; and a second liquid detection sensor provided in the second air supply pathway between the second air-pressure adjustment means and the pulsation damping means, to detect liquid flowing from the second liquid supply pipeline through the pulsation damping means into the second air supply pathway.

9. The pneumatically driven liquid supply apparatus according to claim 8, further comprising:

second flow prevention means operative in response to a detection signal from the second liquid detection sensor.

10. The pneumatically driven liquid supply apparatus according to claim 9, wherein said second flow prevention means is a check valve.

11. A pneumatically driven liquid supply apparatus comprising:

a liquid supply pipeline for supplying a liquid to liquid processing means;

liquid supply means provided in the liquid supply pipeline;

a first air supply pathway for supplying air for driving the liquid supply means to the liquid supply means;

first air-pressure adjustment means provided in the first air supply pathway;

pulsation damping means provided in the liquid supply pipeline downstream of the liquid supply means to damp pulsation of the liquid being fed by the liquid supply means;

a second air supply pathway for supplying to the pulsation damping means air for operating the a pulsation damping means;

second air-pressure adjustment means provided in the second air supply pathway; and a liquid detection sensor provided in the second air supply pathway between the second air-pressure adjustment means and the pulsation damping means, to detect liquid flowing from the second liquid supply pipeline through the pulsation damping means into the second air supply passageway.

12. The pneumatically driven liquid supply apparatus according to claim 11, further comprising:

flow prevention means operative in response to a detection signal from the liquid detection means.

13. The pneumatically driven liquid supply apparatus according to claim 12, wherein said flow prevention means is a check valve.

* * * * *